US009848715B2

(12) United States Patent
Soriano

(10) Patent No.: US 9,848,715 B2
(45) Date of Patent: Dec. 26, 2017

(54) ROCKER

(71) Applicant: KIDS II, INC., Atlanta, GA (US)

(72) Inventor: Alex Soriano, Sandy Springs, GA (US)

(73) Assignee: KIDS II, INC., Atlanta, GA (US)

( * ) Notice: Subject to any disclaimer, the term of this patent is extended or adjusted under 35 U.S.C. 154(b) by 223 days.

(21) Appl. No.: 14/327,871

(22) Filed: Jul. 10, 2014

(65) Prior Publication Data

US 2015/0015036 A1 Jan. 15, 2015

Related U.S. Application Data

(60) Provisional application No. 61/845,516, filed on Jul. 12, 2013.

(51) Int. Cl.

| | |
|---|---|
| ***A47D 13/10*** | (2006.01) |
| ***A47C 7/72*** | (2006.01) |
| ***A47D 1/02*** | (2006.01) |
| ***A47D 15/00*** | (2006.01) |

(52) U.S. Cl.

CPC ..... *A47D 13/102* (2013.01); *A47C 7/72* (2013.01); *A47D 1/02* (2013.01)

(58) Field of Classification Search

CPC ..... A47D 13/102; A47D 13/10; A47D 1/02; A47C 3/029

See application file for complete search history.

(56) References Cited

U.S. PATENT DOCUMENTS

| | | | |
|---|---|---|---|
| 341,238 | A | 5/1886 | Heinss |
| 1,812,699 | A | 6/1931 | Hursh |
| 2,688,997 | A | 9/1954 | Miller |
| 2,788,056 | A | 4/1957 | Parker |
| 2,854,062 | A | 9/1958 | Hetchler |
| 3,047,333 | A | 7/1962 | Stanimir |
| 3,110,519 | A | 11/1963 | Chernivsky |
| 3,119,124 | A | 1/1964 | Krauss |
| 3,158,877 | A | 12/1964 | Cooper |
| 3,206,772 | A | 9/1965 | Sarasin |
| 3,309,718 | A | 3/1967 | Sarasin |
| 3,890,660 | A | 6/1975 | Pedler |
| 4,371,206 | A | 2/1983 | Johnson, Jr. |
| 4,573,224 | A | 3/1986 | Saint |
| 4,635,305 | A | 1/1987 | Wyss |
| 4,674,795 | A | 6/1987 | Nelson |
| 4,718,715 | A | 1/1988 | Ho |
| 5,011,221 | A | 4/1991 | Wise |
| 5,172,955 | A | 12/1992 | Freese et al. |
| 5,178,438 | A | 1/1993 | Beger |
| 5,203,611 | A | 4/1993 | Greenwood |

(Continued)

*Primary Examiner* — David R Dunn
*Assistant Examiner* — Tania Abraham
(74) *Attorney, Agent, or Firm* — Gardner Groff Greenwald & Villanueva, PC

(57) ABSTRACT

A rocker includes a frame and a seat coupled to the frame for receiving an infant therein. The frame includes a front and a rear frame portion generally oppositely extending along a longitudinal axis. The first and second frame portions are pivotally coupled together to move between an upright configuration and a collapsed configuration. The front and rear frame portions include rocking surfaces that are configured to rock on a support surface in a side-to-side motion transverse to the longitudinal axis, with the infant positioned in the seat in a head-to-foot longitudinal orientation.

37 Claims, 8 Drawing Sheets

(56) References Cited

U.S. PATENT DOCUMENTS 5,207,478 A 5/1993 Freese et al.
5,269,591 A 12/1993 Miga, Jr. et al.
5,308,143 A 5/1994 Cheng et al.
5,360,258 A 11/1994 Alivizatos
5,503,458 A 4/1996 Petrie
5,617,594 A 4/1997 Chien
5,694,655 A * 12/1997 Shepler ..... A47D 9/02 5/101
5,868,459 A 2/1999 Welsh, Jr.
6,174,028 B1 1/2001 Yang et al.
6,299,247 B1 10/2001 Meeker et al.
6,341,816 B1 1/2002 Chen et al.
6,361,106 B1 * 3/2002 Huang ..... A47D 13/107 297/16.1
6,378,940 B1 * 4/2002 Longoria ..... A47D 9/02 297/217.3
6,520,862 B1 2/2003 Armbruster et al.
6,540,292 B2 4/2003 Darling et al.
6,679,779 B2 * 1/2004 Tai ..... A47D 13/102 297/33
6,682,137 B2 1/2004 Hsia
6,682,148 B1 1/2004 Chen
6,687,928 B1 2/2004 Wilson
6,811,217 B2 11/2004 Kane et al.
6,824,472 B2 11/2004 Armbruster et al.
6,857,966 B2 2/2005 Armbruster et al.
6,877,802 B2 4/2005 Christensen et al.
6,902,230 B2 6/2005 Chen
7,445,559 B2 11/2008 Kakuda
7,455,353 B2 11/2008 Favorito et al.
7,506,922 B2 * 3/2009 Schulte ..... A47C 3/03 297/131
7,727,078 B2 6/2010 Arnold, IV et al.
7,779,490 B2 8/2010 Bergkvist
7,789,762 B2 9/2010 Greger et al.
7,824,273 B2 11/2010 Clapper et al.
7,837,570 B2 11/2010 Kwon
8,029,377 B2 10/2011 Velderman et al.
8,038,207 B2 10/2011 Flannery
8,182,355 B2 5/2012 Bapst et al.
8,187,111 B2 5/2012 Velderman et al.
8,205,943 B2 6/2012 Zhong
8,844,072 B2 * 9/2014 Bellows ..... A47D 9/02 5/101
8,845,023 B2 * 9/2014 Chen ..... A47D 13/102 297/258.1
2003/0020317 A1 * 1/2003 Keegan ..... A47D 13/107 297/446.2
2006/0103178 A1 5/2006 Wun
2007/0007804 A1 * 1/2007 Pemberton ..... A47D 13/107 297/260.2
2007/0096460 A1 5/2007 Lan
2011/0127810 A1 * 6/2011 Lee ..... A47D 13/105 297/16.1
2011/0148155 A1 6/2011 Chapman et al.
2012/0180212 A1 * 7/2012 Gooris ..... A47D 13/107 5/101
2012/0181830 A1 7/2012 Gooris
2013/0214574 A1 8/2013 Chapman et al.
2014/0210238 A1 * 7/2014 Kania ..... A47C 3/029 297/184.1

* cited by examiner

ROCKER

CROSS-REFERENCE TO RELATED APPLICATION

This application claims the priority benefit of U.S. Provisional Patent Application Ser. No. 61/845,516 filed Jul. 12, 2013, the entirety of which is hereby incorporated herein by reference for all purposes.

TECHNICAL FIELD

The present invention relates generally to the field of accessories and support devices for children and infants, and more particularly to rocking child seats, rockers, bassinets, inclined sleeping apparatuses, and the like.

SUMMARY

In example embodiments, the present invention provides a rocker or similar motion device for infants and children including a child receiving receptacle and a collapsible frame assembly attached to and supporting the child receiving receptacle. In one aspect, the present invention relates to a rocker including a frame having a first and a second frame portion and a seat coupled to at least one of the frame portions of the frame. The first and second frame portions each include two legs and an arcuate or radiused lower base portion connecting the two legs together. In example forms, the first and second frame portions are pivotally connected together proximal the respective legs thereof such that one of the frame portions can pivot relative to the other fame portion between an expanded configuration and a collapsed configuration, and wherein the arcuate or radiused lower base portions of the at least two frame portions are configured to rock on a support surface in the expanded configuration. In one form, the radiused portions of the first and second frame portions are generally arcuate and configured to rock on the support surface in a side-to-side motion. In preferred forms, the motion device is configured to receive an infant within the seat such that the infant's body is generally oriented in a front-to-back orientation (longitudinally or axially), and wherein the first and second frame portions are configured to rock the infant side-to-side (transversely). In alternate embodiments, one or both of the radiused portions is/are generally V-shaped and configured to pivot on the support surface, optionally including stops or limit members for limiting or selectively preventing rocking.

In one form, the rocker includes a pair of hubs or axles pivotally connecting the legs of the second frame portion to the legs of the first frame portion. In example embodiments, one or both of the hubs includes a selectively actuated locking mechanism and a push button or other lock release for providing selective pivotal positioning of the second frame portion relative to the first frame portion to vary a seating position or inclination angle. For example, the locking mechanism can be configured to permit the second frame portion to be positioned in any of at least three distinct positions relative to the first frame portion. In example forms, a foot panel is coupled between the legs of one of the first and second frame portions. Optionally, a support system can be provided with the foot panel to include at least one leg for selective contact with the support surface for preventing side-to-side rocking motion of the rocker. Optionally, the rocker can include a seat support tube connected to the hubs for supporting at least portions of the seat coupled thereto. Optionally, a toy bar, canopy or other structure can be pivotally mounted to at least one of the hubs for support and/or pivotal movement relative to at least one of the frame portions.

In example forms, the second frame portion can be positioned in either an upright position or a reclined position in the expanded configuration. In the upright position, at least a portion of the seat is angled at about 45 degrees relative to the support surface such that an infant received within the seat is positioned at an angle of inclination of about 45 degrees relative to the horizontal. In the reclined position, at least a portion of the seat is angled at about 30-32 degrees relative to the support surface such that an infant received within the seat is positioned at an angle of inclination of about 32 degrees.

In another aspect, the invention relates to a rocker including a collapsible frame and an infant receiving receptacle removably coupled to the frame. The collapsible frame includes a first frame portion and a second frame portion pivotally connected together for moving between an expanded configuration and a collapsed configuration. The first and second frame portions each include two legs and a lower base portion connecting the two legs together. The base portions are preferably configured to rock on a support surface. In one form, the infant receiving receptacle is removably coupled to the first frame portion. The base portions of the first and second frame portions are generally arcuate and configured to rock on the support surface. Preferably, the rocker is generally configured to rock on the support surface in a side-to-side motion. The infant is configured to be received within the infant receiving receptacle such that the infant's body is generally oriented in a front-to-back orientation transverse to the rocking motion.

In still another aspect, the invention relates to a rocker including a frame and a seat coupled to the frame for receiving an infant therein. The frame includes front and rear frame sections generally oppositely extending along a longitudinal axis. Preferably, the front and rear frame sections include rocking bases having curved or arcuate surfaces that are configured to rock in a side-to-side motion on a support surface, and the seat is oriented to hold the infant within the seat positioned in a front-to-back orientation with the infants head and feet extending longitudinally and generally perpendicular to the side-to-side rocking motion.

In another aspect, the invention relates to a child support device including a frame having a first frame portion pivotally coupled to a second frame portion. The first frame portion preferably includes first and second legs and a first rocker member extending between distal ends of the first and second legs. The second frame portion preferably includes third and fourth legs with a second rocker member extending between distal ends thereof. The first and second rocker members extend in a transverse direction. Optionally, first and second hubs pivotally couple proximal ends of the first and second legs to proximal ends of the third and fourth legs, whereby the second frame portion is repositionable between a collapsed position generally aligned with first frame portion and at least a first extended position supporting the first frame portion at a first angle of inclination. The child support device further includes a seat mounted to the frame between the first and second legs, the seat defining a head end for supporting a child's head and a foot end for receiving the child's feet, and defining a longitudinal axis between the head end and the foot end, with the longitudinal axis being generally perpendicular to the transverse direction.

In still another aspect, the invention relates to a rocker comprising a seat, a first frame member and a second frame member. The second frame member is preferably pivotally coupled to the first frame member for rotational movement about a transverse axis, and at least one of the first and second frame members includes a rocker base allowing a side-to-side rocking motion in the direction of the transverse axis. Pivotally repositioning the second frame member relative to the first frame member between a first configuration and a second configuration preferably adjusts an angle of inclination of a longitudinal axis of the seat in a plane generally perpendicular to the transverse axis.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

DETAILED DESCRIPTION OF EXAMPLE EMBODIMENTS

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
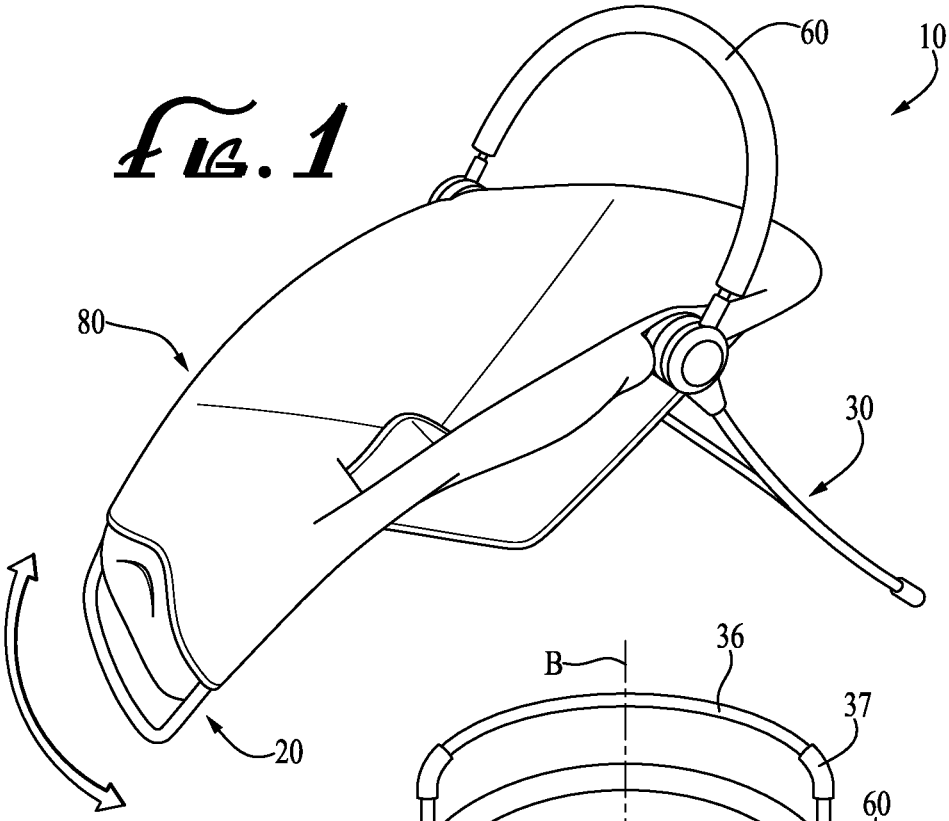
FIG. 1 is a perspective view of a rocker according to an example embodiment of the present invention, showing the rocker in an expanded and upright configuration.
Figure 2:
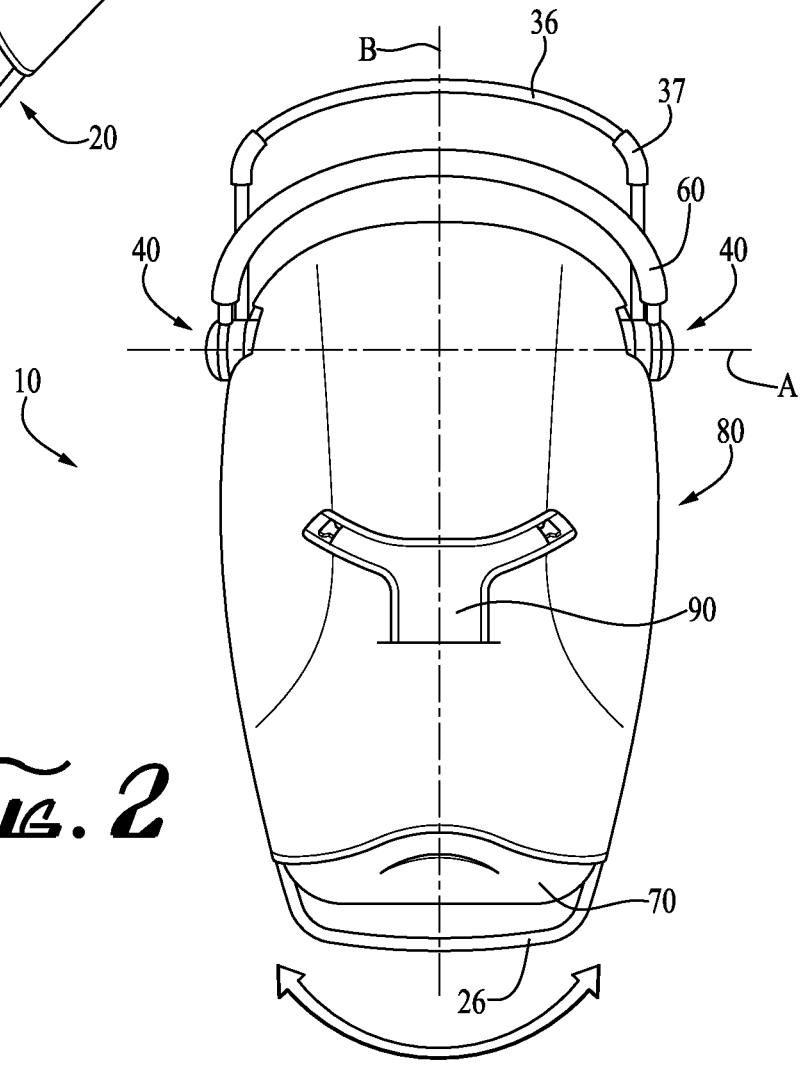
FIG. 2 is a top view of the rocker of FIG. 1.
Figure 3:
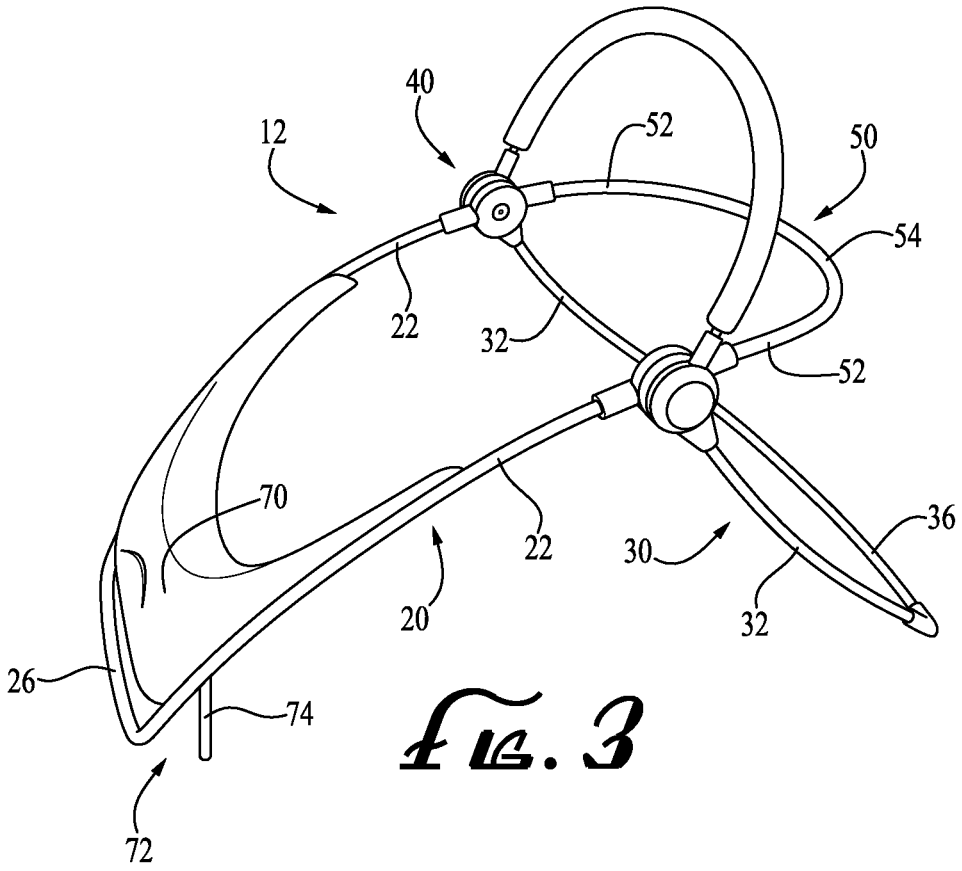
FIG. 3 is a perspective view of a frame of the rocker of FIG. 1, with the fabric or soft goods of the seat sling removed.

With reference now to the drawing figures, wherein like reference numbers represent corresponding parts throughout the several views, FIGS. 1-3 show a rocker 10 according to an example embodiment of the present invention. The rocker 10 generally comprises a collapsible frame 12 having a first frame portion 20 and a second frame portion 30, which are pivotally coupled together and configured to rest on a support surface S (see FIG. 6A) for rocking in a side-to-side motion (see direction arrow in FIG. 1). Preferably, the collapsible frame 12 is configured to support an infant receiving receptacle or seat 80 (adapted for receiving an infant) and the first and second frame portions 20, 30 are convertible between an erect or extended configuration, as shown in FIG. 1, and a collapsed or compact/folded configuration, as shown in FIGS. 6C and 7. Preferably, the seat 80 defines a head end and a foot end longitudinally opposite one another for receiving the infant's head and feet, and rocks in a side-to-side direction generally transverse or perpendicular to the head-to-foot longitudinal direction. In example embodiments, the rocker 10 can be folded to the collapsed configuration for travel or storage and can be unfolded to the extended configuration for rocking side-to-side. In example embodiments, the second frame portion 30 is repositionable between at least two angular positions such that the recline angle of the seat 80 (as will be described below) can be selectively adjusted by a caregiver.

As depicted in FIGS. 2-3, the first and second frame portions 20, 30 are pivotally mounted together by hubs or pivot couplings 40 such that the second frame portion 30 can pivot relative to the first frame portion 20. Typically, the pivot couplings 40 are generally positioned between the head and foot ends of the seat 80, which provides greater structural integrity to the frame 12 in addition to stability. As shown in FIG. 2, the pivot couplings 40 are positioned between the head and foot ends of the seat 80 and generally closer to the head end than the foot end. In example forms, the first and second frame portions 20, 30 each comprise a pair of legs 22, 32 and rocking surfaces or base portions 26, 36 at their distal ends, opposite the hubs 40, whereby the first and second frame portions each comprise a generally U-shaped and/or V-shaped member connected at their open ends by the hub. The legs 22, 32 are generally coupled to the hubs 40 and the base portions 26, 36 are configured to rest on a support surface. Preferably, the base portions 26, 36 are arcuate or smoothly curved such that the frame 12 (with the frame portions 20, 30 extending therefrom and the base portions 26, 36 resting on the support surface) rocks in a rocking motion back and forth, side-to-side on the support surface. The first and second frame portions 20, 30 are optionally formed of continuous lengths or coupled segments of tubing or rods, for example constructed of plastic, aluminum, steel or other metals and/or substantially rigid structural material(s). In example forms, the length of the first frame portion 20 is generally longer than the second frame portion 30 as shown in FIG. 1, for example about 1.5 to 2 times as long, to create a dynamic rocking motion. Alternatively, the first and second frame portions 20, 30 can be about the same length or have any desired relative lengths. In one example form, the rocker 10 can be manually rocked by a caregiver, and in other embodiments the rocker 10 optionally can be driven by other means, such as for example by an electric motor.

From the pivot couplings 40, the legs 22 of the first frame portions generally extend towards a front end of the rocker 10 in a generally arc-like or curved direction until joining the base portion 26. Similarly, the legs 32 of the second frame portion 30 (pivotally mounted to the pivot couplings 40) extend from the pivot couplings 40 in a back, downward, and curved direction where they join the base portion 36. In some example forms, the radius or curved shape of the legs 22, 32 is substantially similar. Preferably, as will be described below, the second frame portion 30 can pivot relative to the first frame portion 20 such that the distance between the base portions 26, 36 is adjusted. For example, as shown in FIG. 2, the second frame portion is pivotal about a transverse axis A and the extension thereof (e.g., distance between the base portions 26, 36) is defined along a longitudinal axis B, which extends generally perpendicular to axis A. In example forms, stops 37 are optionally provided at the intersection of the legs 32 and the rocker portion 36 to limit the extent the rocker is capable of rocking, for example about 30-70 degrees in either of the side-to-side directions. The stops 37 are preferably configured such that the rotational momentum of the rocker when released from its maximum angle in one of the side-to-side directions (with our without an infant in the seat) does not cause the rocker to tip over when reaching the other of the side-to-side directions.

In example embodiments, a seat support tube 50 (comprising arms 52 and a radiused portion 54) generally extends from the pivot couplings 40 at the head end of the seat area longitudinally opposite the first frame portion 20, which provides additional support for the seat 80. Alternatively, the first frame portion 20 extends continuously to form the seat support tube 50 at the head end. In example forms, the seat support tube 50 is fixed to the pivot couplings 40 such that the tube 50 does not pivot relative to the first frame portion 20. Alternatively, the support tube 50 can be pivotally mounted to provide pivotal movement relative to the first frame portion 20 for adjustment of the head angle of the seat. Optionally, a toy bar 60 is pivotally mounted to the pivot couplings 40 for providing pivotal movement between an upright or in-use position and a collapsed or storage position (see FIG. 5). The toy bar 60 is optionally covered by soft goods, such as a foam cushioning material and a fabric cover material (see FIG. 10), The toy bar 60 can be provided for attachment of toys, pull tags, etc. for entertaining the infant. Optionally, the toy bar 60 may be configured to be a one-arm or mobile toy bar, a canopy or other apparatus to provide entertainment for the infant.

Figure 4:
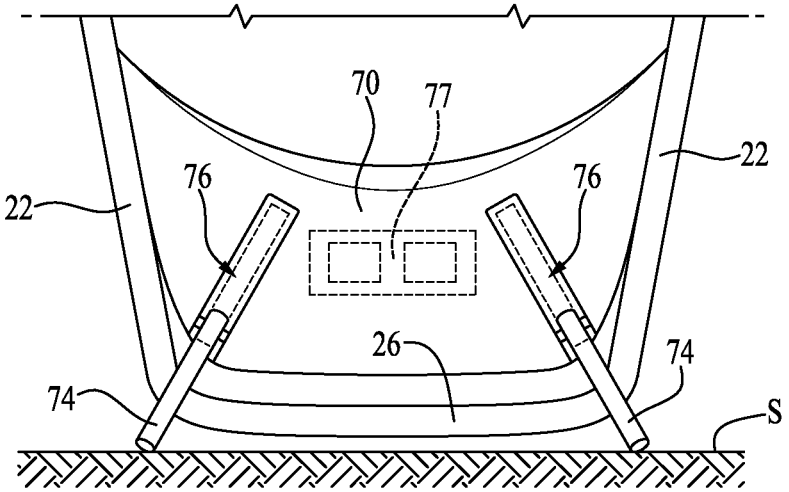
FIG. 4 is a rear view of a portion of the frame of FIG. 3, showing a foot panel having a pair of selectively deployable pivotally mounted feet for providing stability to the rocker and selectively preventing rocking motion.

As depicted in FIGS. 3-4, a foot panel 70 is optionally provided between the legs 22 of the first frame portion 20 at the foot end of the seat to provide for additional bracing of the rocker 10 and support of the infant's feet. Generally, the foot panel 70 is constructed from a plastic or other substantially rigid material and is shaped to generally follow the curved contour of the first frame portion 20, for example, such that the legs of an infant seated within the seat 80 are comfortably positioned thereon (i.e., a portion of the seat 80 covering the panel 70). Preferably, at least a portion of the foot panel does not extend entirely to the base portion 26 (e.g., providing spacing therebetween), for example to provide the caregiver with a handle (e.g., the base portion) for grasping and carrying the rocker 10 in the collapsed configuration (see FIG. 7). Optionally, the handle may be formed with the foot panel 70 or may be permanently or removably attached to any portions of the first frame portion 20 and/or the base portion 26. In example forms, the foot panel 70 generally comprises a support or bracing system 72 for supporting the front frame portion 20 in a non-rocking configuration. For example, at least one pivotally mounted foot or leg 74 can be provided for pivotal extension (extended position shown in solid lines in FIG. 4) such that the base portion 26 of the first frame portion 20 is elevated above the support surface S, thereby preventing the rocker from rocking. In some forms, the foot panel 70 comprises recessed channels 76 for receiving and retaining the feet or legs 74 in a retracted position (shown in broken lines in FIG. 4) when the rocker 10 is intended to be rocked. In the depicted embodiment, the feet 74 pivot about a pin coupling or hinge between an extended position and a retracted position, but in alternate forms may extend telescopingly, axially or otherwise. Optionally, the foot panel 70 can comprise additional features or accessories 77, including but not limited to, a vibration unit, music player, speakers, other electronics, batteries, etc.

The seat 80 is generally in the form of a removable and washable soft goods component for receiving and supporting an infant therein. Generally, the seat comprises a sling or receptacle having first and second sides 82, a foot end 84, a leg portion 86, a back portion 87, and a harness 90 (see FIG. 5). In example forms, at least portions of the edge or periphery of the seat 80 comprise one or more attachment members, pockets or lips (e.g., engagement features) for providing engagement with one or more portions of the frame 12. Typically, the upper portion of the back portion 87 is attached to the seat support tube 50 and the foot end 84 is pulled tightly and wrapped around the sides of the first frame portion 20 (and foot panel 70), wherein a buckle or other attachment means (not shown) is provided for interengagement to removably secure the foot end 84 thereto. Optionally, the seat 80 and/or fame 12 can comprise other interengagement features, clips, buckles, snaps, couplings, etc. for removable engagement of the seat 80 to the frame 12. In example embodiments, the harness 90 is generally configured to restrain at least the waist and the crotch of the infant. Alternatively or additionally, the harness 90 may include other forms of restraints (e.g., shoulder straps, etc.), or may not include any restraints.

Figure 5:
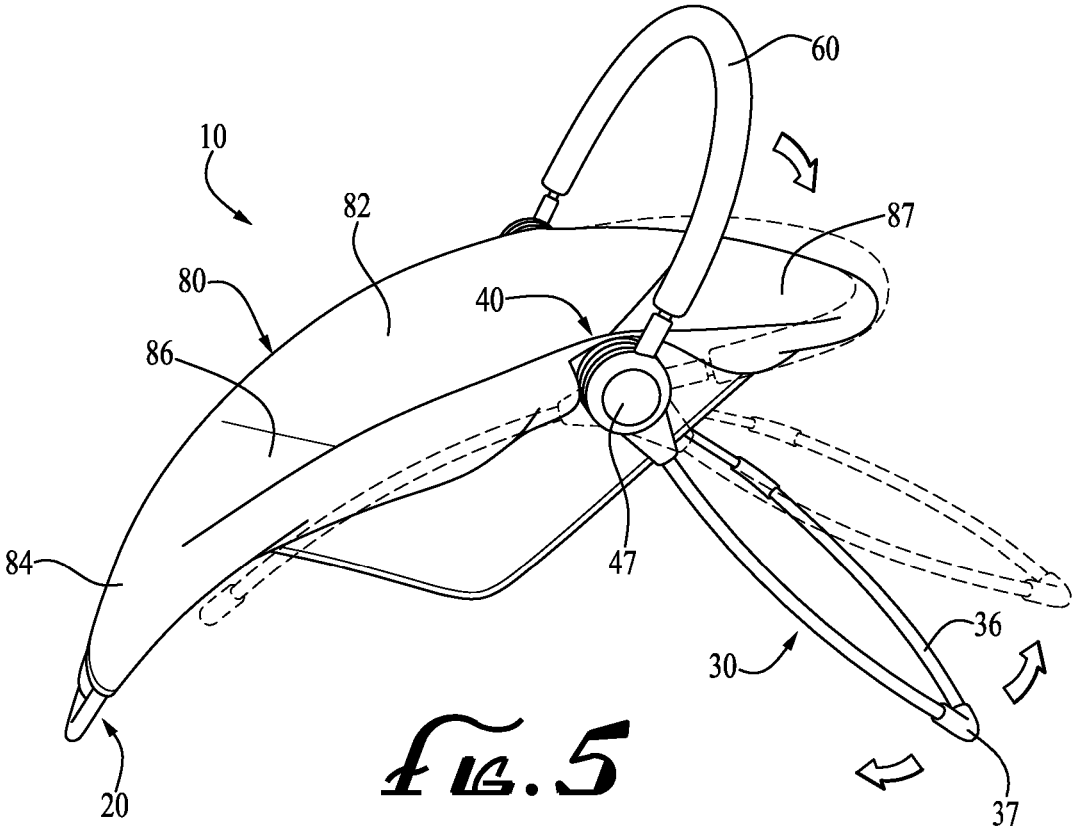
FIG. 5 is a perspective view of the rocker of FIG. 1, showing a plurality of configurations of the frame according to an example embodiment of the present invention.
Figure 6A:
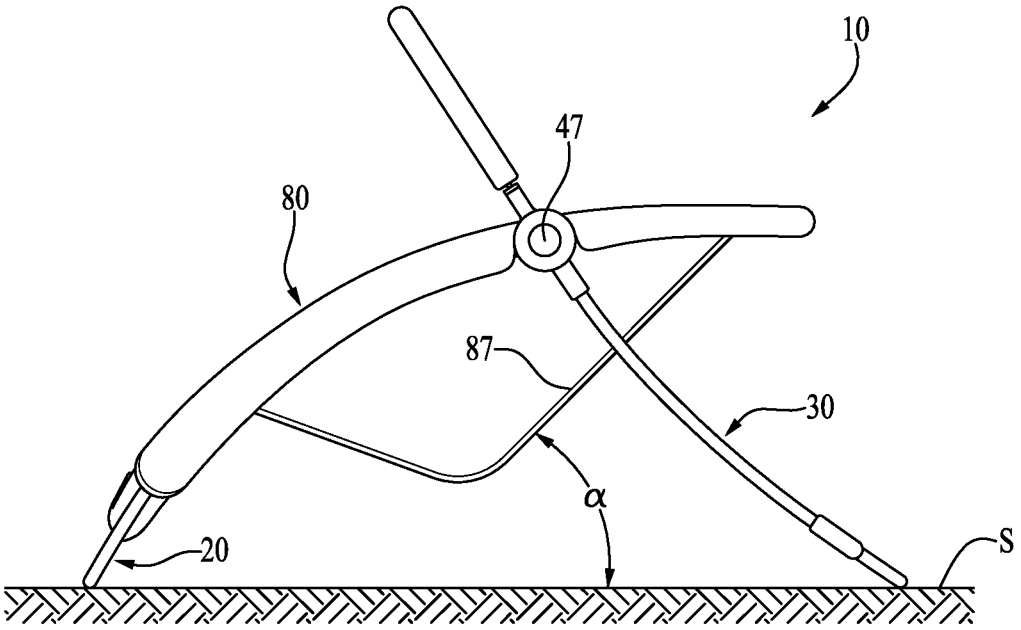
FIG. 6A is a side view of the rocker of FIG. 1 resting on a support surface, the frame being positioned in an expanded and upright configuration.
Figure 6B:
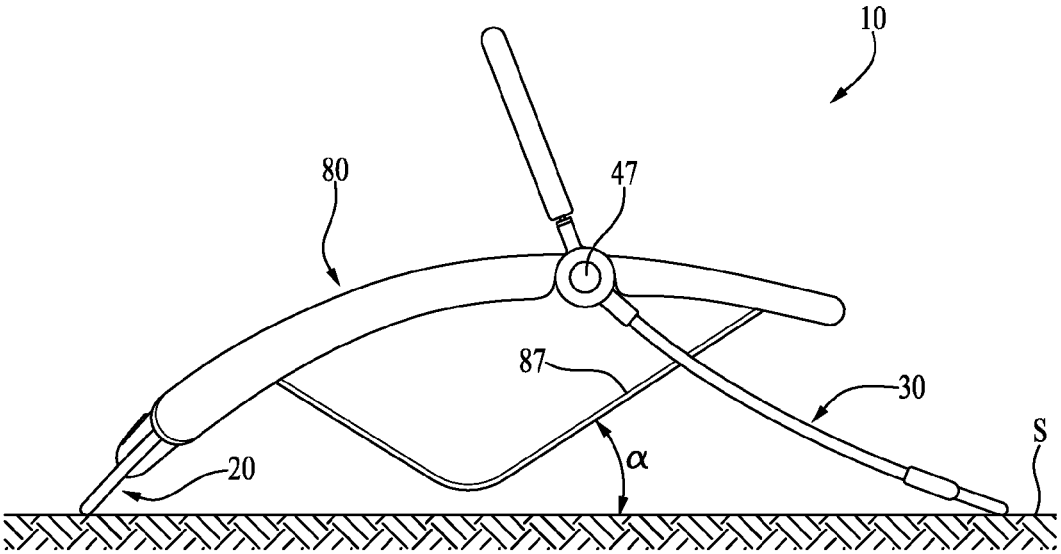
FIG. 6B is a side view of the rocker of FIG. 1 resting on a support surface, the frame being positioned in an expanded and reclined configuration.
Figure 6C:
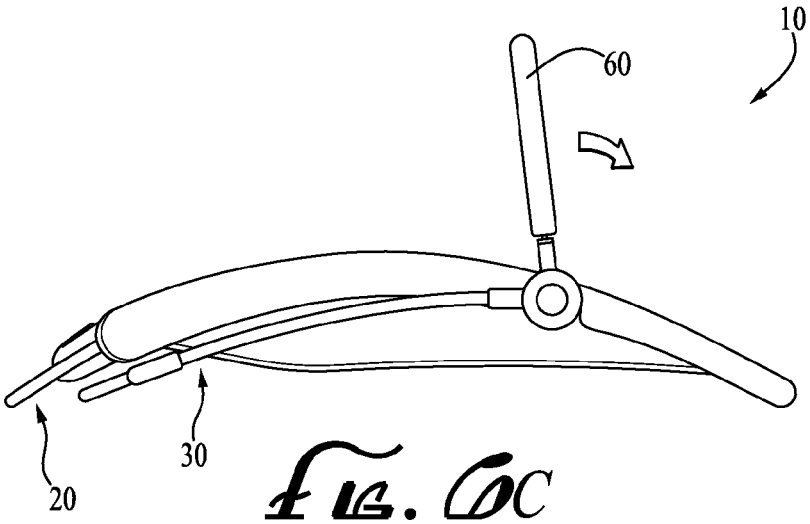
FIG. 6C is a side view of the rocker of FIG. 1, showing the frame being positioned in a collapsed or storage configuration.
Figure 7:
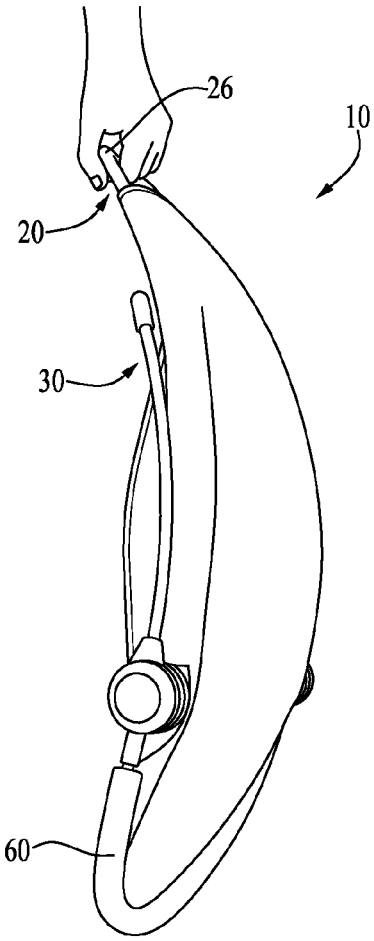
FIG. 7 is a perspective view of the rocker of FIG. 6C, showing a user holding the rocker with one hand by grasping a portion of the frame.

As depicted in FIGS. 5-7, the rocker 10 is preferably movable between a plurality of configurations. For example, the rocker 10 is preferably movable between an erect or extended configuration (see FIGS. 6A-B) and a collapsed or compact/folded configuration (see FIGS. 6C-7). As will be described below in greater detail, the pivot couplings 40 each comprise push buttons 47 or other lock releases to free engagement of the second frame portion 30 from the first frame portion 20 at the hub 40 such that the second frame portion 30 can selectively pivot relative to the first frame portion 20. According to one example form, the pivot couplings can be locked in three distinct positions, and the push buttons (when pressed simultaneously) free the second leg portion 30 to allow pivotal portion thereof relative to the first leg portion 20 to vary the seat position or inclination. In alternate embodiments, one, two or more than three distinct positions are enabled, or a continuous range of user-selected positioning is provided. In the extended configuration, the rocker 10 can preferably be configured to provide a plurality of inclination angles relative to the support surface S. As shown in FIG. 6A, the second frame portion 30 is positioned relative to the first frame portion 20 (e.g., an upright extended configuration) such that the back portion 87 of the seat 80 is at an incline angle α of about 45 degrees relative to the support surface. And, as shown in FIG. 6B, the second frame portion 30 is positioned relative to the first frame portion 20 (e.g., a reclined extended configuration) such that the back portion 87 of the seat 80 is at an incline angle α of about 32 degrees relative to the support surface. Angular repositioning of the second frame portion relative to the first frame portion effectively rotates the first frame portion about a fulcrum defined by the contact point of the foot end of the first frame portion with the support surface (and thereby varies the inclination angle of the longitudinal axis of the seat, which is attached to the first frame member) Optionally, the second frame portion 30 can be configured to be positioned as desired to provide the back portion 87 of the seat 80 at other included angles as desired, for example between about 0-80 degrees of inclination. In the collapsed configuration, the second frame portion 30 is generally adjacent the first frame portion and extending in a similar direction. Preferably, the base portion 26 of the first frame portion 20 can be used as a handle for carrying the rocker by a caregiver (see FIG. 7).

In the collapsed configuration, as depicted in FIGS. 6C and 7, the second frame portion 30 is generally adjacent the first frame portion 20 such that the base portions 26, 36 are generally adjacent and aligned with one another. The curved directions of the legs 22, 32 are preferably similarly configured and aligned with each other that they can provide a compact nesting fit when collapsed. Preferably, as described above, the base portion 26 acts as a handle for providing a grasping area for carrying the rocker 10. Optionally, the handle can be configured with rounded gripping surfaces or otherwise as desired to provide for comfort and ease of use for the caregiver or user that is grasping and carrying the rocker 10.

Figure 9:
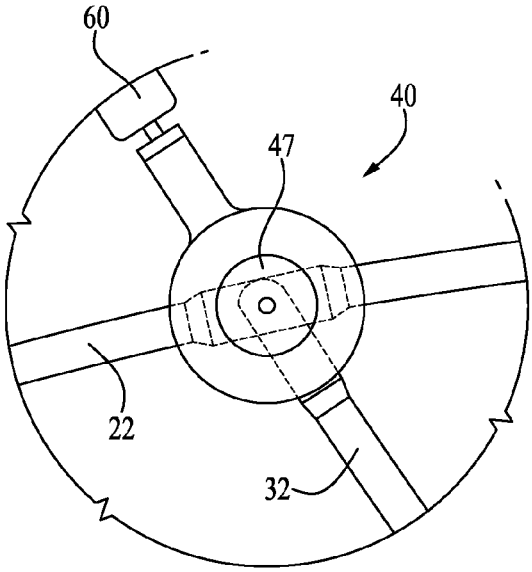
FIG. 9 is a detailed view of a pivot coupling of the rocker of FIG. 8.
Figure 8:
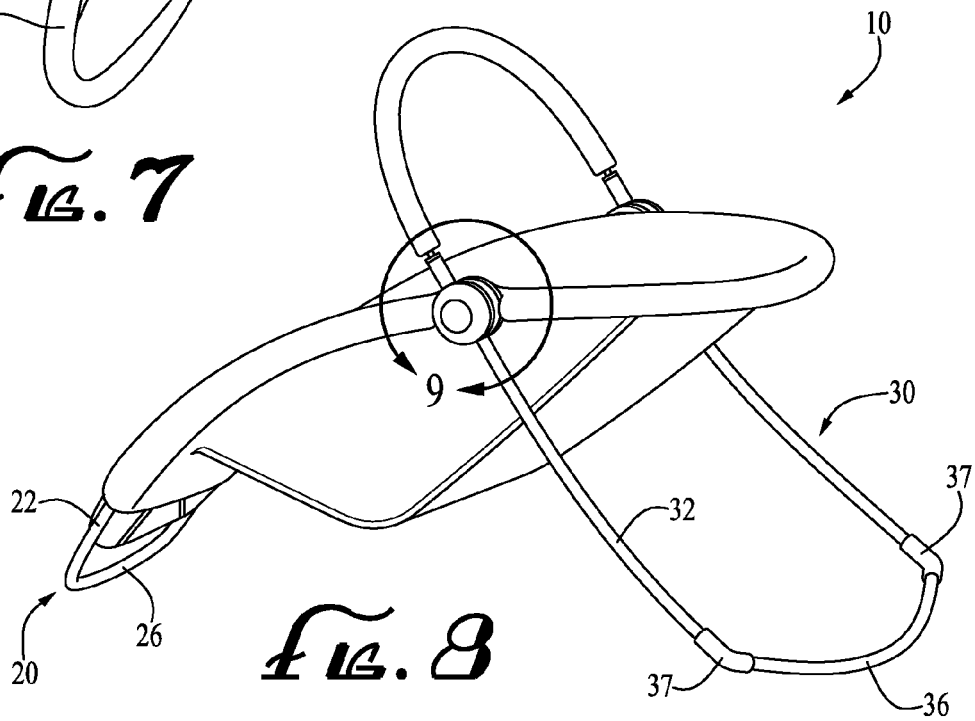
FIG. 8 is a rear perspective view of the rocker of FIG. 1.
Figure 10:
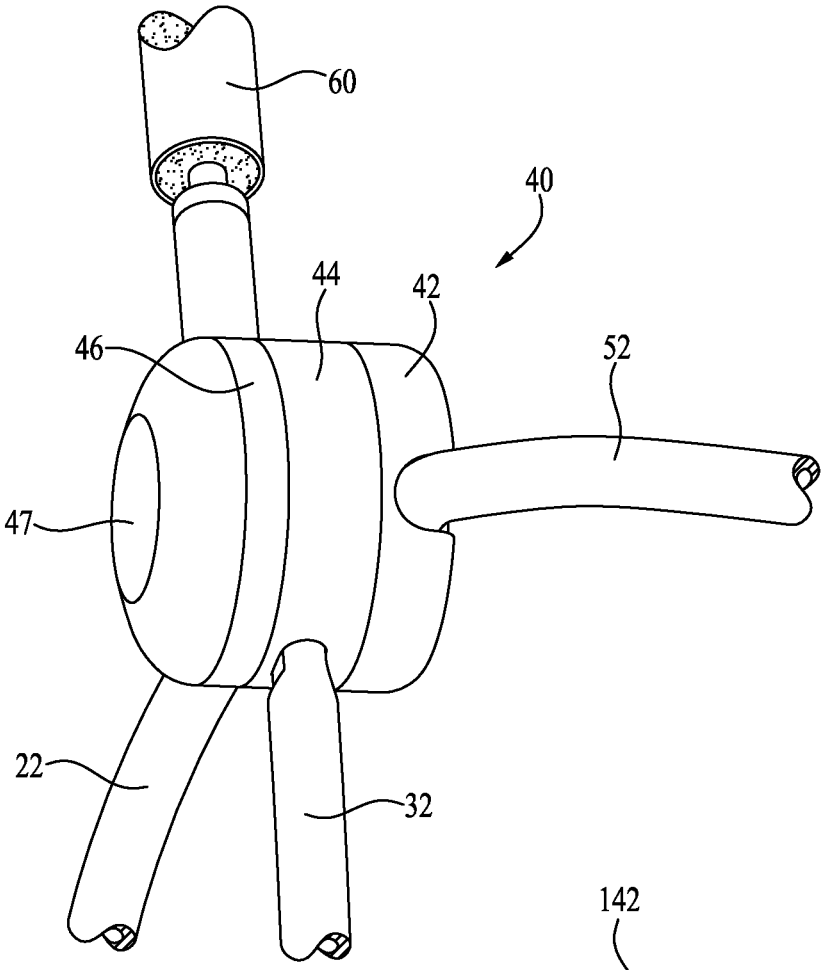
FIG. 10 is a rear perspective view of the pivot coupling and canopy support of FIG. 9.

As depicted in FIGS. 8-10, the pivot couplings or hubs 40 preferably provide for the selective pivotal motion of the second leg portion 30 relative to the first leg portion 20 by operation of the push button lock releases 47. As a safety feature, it is preferred that both push buttons must be pressed at the same time (simultaneously) in order to allow pivotal movement of the second leg portion 30. In example embodiments, each pivot coupling 40 generally comprises an inboard portion 42, an intermediate portion 44, and an outboard portion 46. The leg 22 and the seat support tube 52 are generally rigidly connected to the inboard portion 42, the intermediate portion pivotally mounts to the inboard portion 42 and receives the leg portion 32, and the outboard portion 46 pivotally mounts to the inboard and intermediate portions 42, 44 and receives the toy bar 60. Optionally, the pivot coupling 40 is configured for with sockets or couplings for receiving or fastening the legs, tubes, bars, etc. for connection therewith. Preferably, the push button 47 is positioned near the outboard portion 46 of the pivot coupling 40 to be pushed and actuated for movement into the pivot coupling 40 and release a locking mechanism therein such that the leg portion 32 can be repositioned in either of the other two positions (three total positions—collapsed/storage, expanded/upright, and expanded/reclined). Optionally, the locking mechanism that is within the pivotal coupling can comprise four or more distinct positions such that the second frame portion can be locked at four or more positions, or can provide a continuous range of positioning adjustment to the inclination of the seat 80. In alternate forms, the push button 47 can be replaced with a switch or other pivotally mounted member for actuation thereof to lock and unlock the second frame portion 30 relative to the first frame portion 20. Additionally or alternatively, the seat can comprise one or more zippers or other adjustment features for selectively expanding/contracting the head and/or foot ends of the seat 80 such that the angle of inclination of the seat 80 relative to the ground surface is adjusted without adjusting the angle of the second frame portion 30 relative to the first frame portion 20. As briefly described above, one or more portions of the seat support tube 50 may be formed with the legs 22 of the first frame portion 20. Optionally, a flattened portion may be provided on one or both legs/tubes (including the legs 32 and toy bar 60) to provide ease of attachment and functionality of the pivot couplings 40.

Figure 11A:
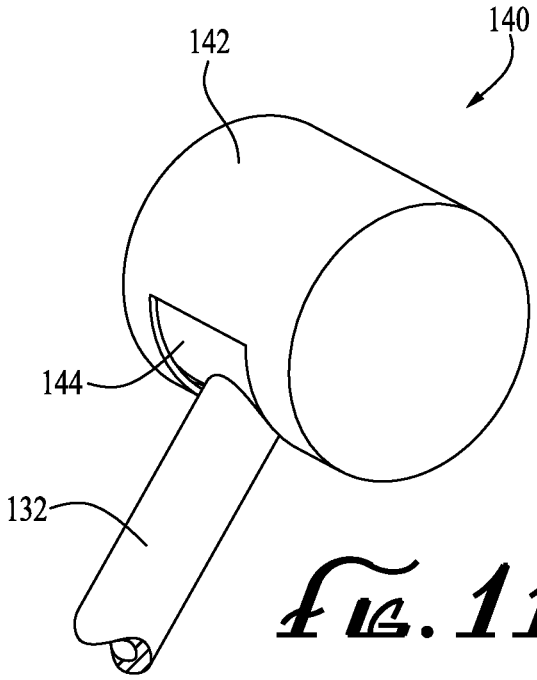
FIG. 11A is a perspective view of a pivot coupling for use with a rocker according to another example embodiment of the present invention.
Figure 11B:
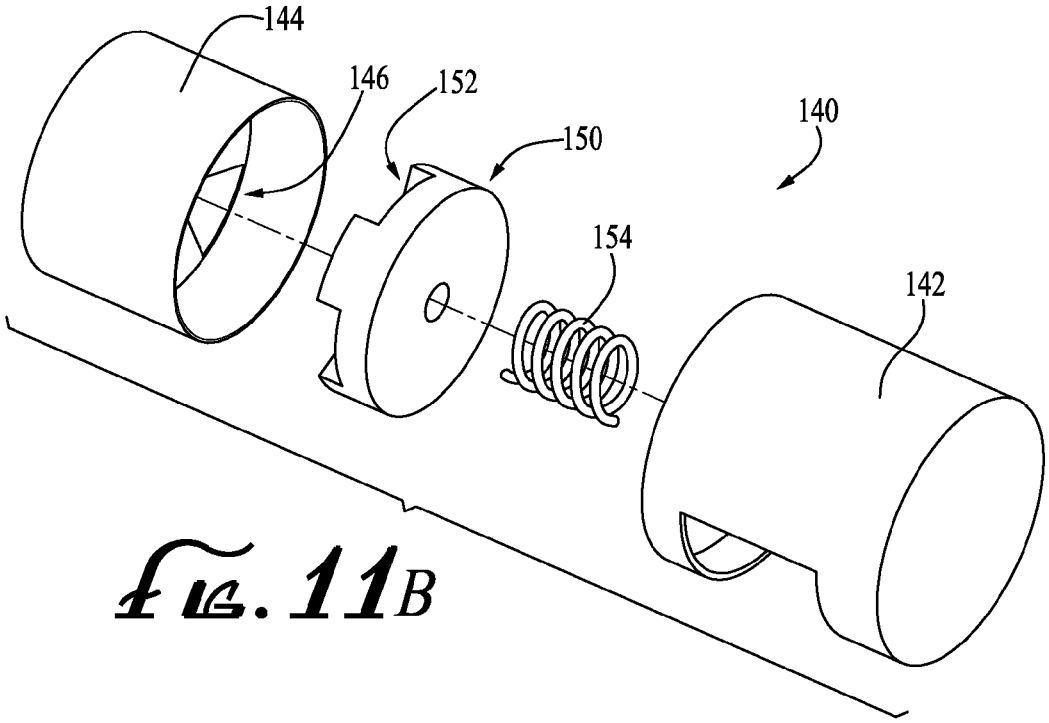
FIG. 11B is an exploded perspective view of the pivot coupling of FIG. 11A.

FIGS. 11A-B show a pivotal coupling 140 according to another example embodiment of the present invention. As depicted, the pivotal coupling 140 generally comprises an outer housing member 142, an internal member 144 for receiving portions of the leg 132, and a locking mechanism. In one example form, the locking mechanism comprises a gear 150 having a radial array of locking teeth 152 for interengagement with a complementary radial array of recesses 146 formed within the internal member 144, and a biasing member 154 for biasing the gear 150 against the internal member 144 to engage the teeth 152 with the recesses 146 to lock the frame in a selected position. Preferably, a push button or other release (not shown) can be actuated to disengage the teeth 152 from the recesses 146 such that the internal member 144 (and leg 132 coupled thereto) can pivot relative to the outer housing 142, thereby providing adjustment to the second frame portion. In example forms, the legs of the first frame portion, the arms of the seat support tube, and the toy bar can be mounted as desired to portions of the outer housing 142. In example forms, the legs of the first frame portion and the arms of the seat support tube are rigidly attached to the outer housing 142 and the toy bar is pivotally mounted to the outer housing 142.

Figure 12:
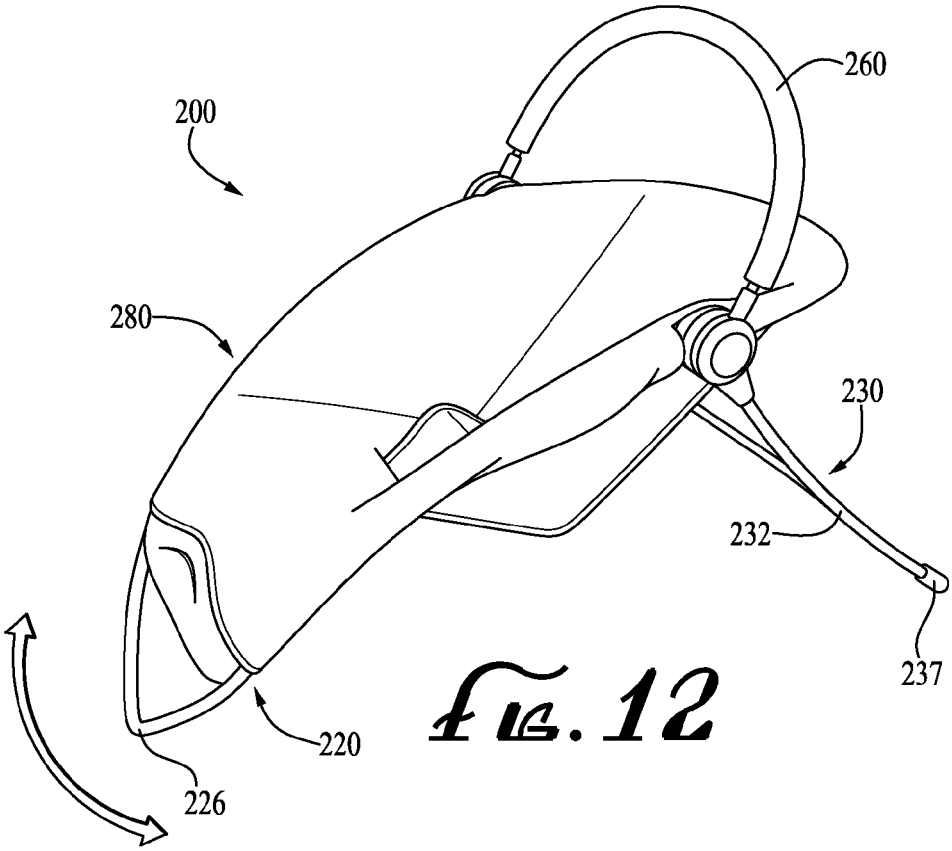
FIG. 12 is a perspective view of a rocker according to another example embodiment of the present invention.

FIG. 12 shows a rocker 200 according to another example embodiment of the present invention. As depicted, the first frame portion 220 comprises a V-shaped base portion 226 and the second frame portion 230 comprises a radiused or arcuate base portion. Typically, the V-shaped base portion 226 pivots on the support surface as the radiused base portion 236 rocks on the support surface, thereby providing a sharper or more pronounced non-traditional side-to-side rocking motion. For example, the rocking motion at the rear end (e.g., rocking about the radiused base portion of the second frame portion 230) is generally more pronounced than the pivoting motion at the front end (e.g., rocking about the V-shaped pivot or base portion 226). Optionally, the V-shaped base portion 226 may be replaced with a more arcuate-like base portion (as similarly described above), but may comprise a radius of curvature that is smaller than the radius of curvature of the radiused base portion of the second frame portion 230, which can create a more pronounced rocking motion at the rear end. Preferably, as described above, stops 237 are provided at the intersection of the legs 232 and the rocker base portion such that the range of motion of the rocker 200 is limited at each end of the range of rocking motion to prevent tipping.

Figure 13:
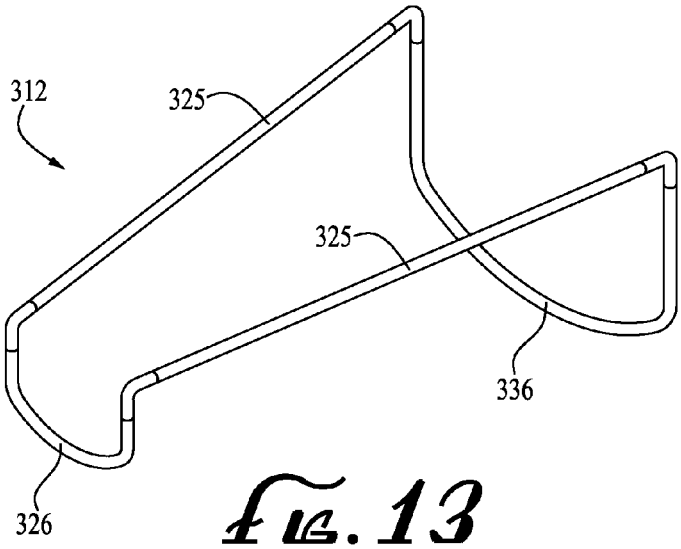
FIG. 13 is a perspective view of a rocker frame according to another example embodiment of the present invention.

FIG. 13 shows a rocker frame 312 according to another example embodiment of the present invention. Generally, a pair of upper frame members 325 extend longitudinally along left and right sides of the frame between corresponding pairs of upright front legs and rear legs, with distal or lower ends of the legs being connected together by transversely extending rocker portions 326, 336. The upper frame members 325 are preferably configured for suspending or supporting the soft goods seat or support sling (unshown). In some example forms, rigid or semi-rigid elbows are provided for coupling the front and rear legs to the upper frame members 325. In some forms, the elbows may comprise pivots to provide for collapsing or adjusting and angle of inclination of the seat as similarly described above.

In further example embodiments, the rocker apparatus of the present invention may be utilized for other side-to-side motion devices (i.e., rocking in a direction generally transverse to the head-to-foot longitudinal direction) that provide varying degrees of inclination relative to the support surface. For example, in one form, the frame and/or seat can be configured to recline the infant at about 10-30 degrees relative to the support surface and provide a rocking, side-to-side motion (e.g., a sleeper). According to another form, the frame and/or seat can be configured to recline the infant between about 0-10 degrees relative to the support surface and provide a rocking, side-to-side motion (e.g., a bassinet). The infant receiving receptacle may or may not have a harness and/or other restraints depending on the particular motion device (rocker, sleeper, or bassinet). According to the ASTM standards, bassinets typically do not contain a restraint system in the occupant area, sleepers typically are not required to have restraints but may have waist and crotch restraints, and rockers typically must have at least waist and crotch restraints.

While the invention has been described with reference to preferred and example embodiments, it will be understood by those skilled in the art that a variety of modifications, additions and deletions are within the scope of the invention, as defined by the following claims.

What is claimed is:

1. A rocker comprising:

a frame having a first frame portion, a second frame portion, and a pair of hubs, the first and second frame portions each comprising two legs and a rocker portion extending between distal ends of the two legs, said hubs pivotally connecting proximal ends of the legs of the second frame portion to proximal ends of the legs of the first frame portion, the frame further comprising a seat support tube coupled to the hubs and extending opposite the first frame portion; and a seat coupled to and extending along the legs of the first frame portion and at least a portion of the seat support tube, and defining a head end and a foot end, with a longitudinal axis extending therebetween, wherein the frame is selectively reconfigurable between at least two expanded configurations and a collapsed configuration, and wherein the rocker portions allow the frame to rock on a support surface transversely relative to the longitudinal axis.

2. The rocker of claim 1, wherein the length of the first frame portion is greater than the length of the second frame portion.

3. The rocker of claim 1, wherein the rocker portions of the first and second frame portions are each generally arcuate.

4. The rocker of claim 3, wherein the rocker portion of at least one of the first and second frame portions is generally V-shaped.

5. The rocker of claim 1, wherein the seat comprises a flexible soft goods sling.

6. The rocker of claim 1, wherein each of the hubs comprise a locking mechanism and a release for providing selective pivot positioning of the second frame portion relative to the first frame portion.

7. The rocker of claim 6, wherein the locking mechanism is configured such that the second frame portion can be positioned in at least three distinct positions relative to the first frame portion.

8. The rocker of claim 1, further comprising a foot panel coupled between the legs of one of the first and second frame portions.

9. The rocker of claim 8, further comprising at least one selectively deployable foot to prevent rocking of the rocker.

10. The rocker of claim 8, wherein the foot panel further comprises at least one entertainment feature selected from a vibration unit, a music player, and/or speakers.

11. The rocker of claim 1, further comprising a toy bar for supporting at least one toy above the seat.

12. The rocker of claim 1, further comprising a stop at each end of at least one of the rocker portions to limit the rocking motion.

13. The rocker of claim 1, wherein the second frame portion is repositionable between an upright position and a reclined position to vary an inclination angle of the seat.

14. The rocker of claim 13, wherein in the upright position, a seatback portion of the seat is angled at about 45 degrees relative to the support surface.

15. The rocker of claim 13, wherein in the reclined position, a seatback portion of the seat is angled at about 32 degrees relative to the support surface.

16. The rocker of claim 1, wherein the first and second frame portions are pivotally connected at proximal ends of their respective legs to permit the second frame portion to pivot relative to the first frame portion.

17. A child support device comprising:

a frame comprising a first frame portion coupled to a second frame portion, the first frame portion comprising first and second legs and a first rocker member extending between distal ends of the first and second legs, and the second frame portion comprising third and fourth legs with a second rocker member extending between distal ends thereof, the first and second rocker members extending in a transverse direction, and said proximal ends of the third and fourth leas being coupled to a fixed position at the proximal ends of the first and second leg; and a seat mounted to the frame between the first and second legs wherein the seat is coupled to and extends along the first and second legs, the seat defining a head end for supporting a child's head and a foot end for receiving the child's feet, and defining a longitudinal axis between the head end and the foot end, the longitudinal axis being generally perpendicular to the transverse direction;

wherein the frame is positionable between at least first and second extended positions and a collapsed position; and wherein the head end of the seat is positioned at the proximal end of the first frame portion and the foot end of the seat is positioned at the distal end of the first frame portion.

18. The child support device of claim 17, wherein the first frame portion and the second frame portion are pivotally coupled together.

19. The child support device of claim 18, further comprising first and second hubs pivotally coupling proximal ends of the first and second legs to proximal ends of the third and fourth legs, whereby the second frame portion is repositionable between the collapsed position generally aligned with first frame portion and at least the first extended position supporting the first frame portion at a first angle of inclination.

20. The child support device of claim 19, wherein the second frame portion is further repositionable to the second extended position supporting the first frame portion at a second angle of inclination different than the first angle of inclination.

21. The child support device of claim 19, wherein the first and second hubs allow pivotal motion of the second frame portion relative to the first frame portion about a rotational axis extending in the transverse direction.

22. The child support device of claim 19, further comprising a toy bar coupled to at least one of the first and second hubs for supporting at least one toy over the seat.

23. The child support device of claim 19, wherein the first and second rocker members allow side-to-side rocking of the seat in the transverse direction, and wherein repositioning of the second frame portion relative to the first frame portion allows repositioning of the seat to vary the angle of inclination of the longitudinal axis in a plane generally perpendicular to the transverse direction.

24. The child support device of claim 17, wherein the first and second rocker members provide a side-to-side rocking motion in the transverse direction generally rotationally about the longitudinal axis.

25. The child support device of claim 17, further comprising at least one selectively deployable foot extendable from at least one of the first and second rocker members to restrict rocking of the child support device.

26. The child support device of claim 17, wherein the seat comprises a flexible soft goods material.

27. The child support device of claim 17, further comprising a foot panel extending between the first and second legs at the foot end of the seat.

28. The child support device of claim 27, wherein the foot panel comprises at least one entertainment feature selected from a vibration unit, a music player, and/or speakers.

29. The child support device of claim 17, wherein at least one of the rocker members comprises stops at opposed ends thereof to limit the rocking motion of the child support device.

30. The child support device of claim 17, wherein at least one of the rocker members defines a V-shaped contact surface.

31. A rocker comprising a seat, a first frame member and a second frame member, each frame member comprising a base portion configured to rest on a support surface with the base portions of the first and second frame members positioned a distance apart from one another along the support surface, the second frame member being pivotally coupled to the first frame member for rotational movement about a transverse axis, wherein the seat is coupled to and extending along the first frame member, and at least one of the first and second frame members comprising a rocker base allowing a side-to-side rocking motion in the direction of the transverse axis, wherein pivotally repositioning the second frame member relative to the first frame member between a first configuration and a second configuration adjusts the distance between the base portions and adjusts an angle of inclination of a longitudinal axis of the seat in a plane generally perpendicular to the transverse axis; and wherein further pivotally repositioning the second frame member relative to the first frame member to a third configuration generally aligns the first frame member and the second frame member into a compact collapsed state.

32. The rocker of claim 31, further comprising at least one selectively deployable foot extendable from the rocker base to restrict the side-to-side rocking motion.

33. The rocker of claim 31, wherein the seat comprises a flexible soft goods material.

34. The rocker of claim 31, further comprising a toy bar supporting at least one toy over the seat.

35. The rocker of claim 31, further comprising a foot panel at a foot end of the seat.

36. The rocker of claim 35, wherein the foot panel comprises at least one entertainment feature selected from a vibration unit, a music player, and/or speakers.

37. The rocker of claim 31, further comprising stops at opposed ends of the rocker base to limit the side-to-side rocking motion.

* * * * *